US005357244A

United States Patent [19]

van Zijl

[11] Patent Number: 5,357,244

[45] Date of Patent: Oct. 18, 1994

[54] PAGER SYSTEM WITH USE MONITORING

[75] Inventor: Nicolaas C. van Zijl, Woudrichem, Netherlands

[73] Assignee: Ericsson Radio Systems B.V., Emmen, Netherlands

[21] Appl. No.: 894,074

[22] Filed: Jun. 5, 1992

[30] Foreign Application Priority Data

Jun. 6, 1991 [NL] Netherlands ..... 9100977

[51] Int. Cl.[5] ..... G08B 5/22

[52] U.S. Cl. ..... 340/825.17; 340/825.44; 340/825.36; 340/636; 455/343

[58] Field of Search ..... 540/636, 825.17, 825.44, 540/825.27, 823.36, 635; 455/343

[56] References Cited

U.S. PATENT DOCUMENTS

| | | | |
|---|---|---|---|
| 3,808,538 | 4/1974 | Goransson et al. | 325/22 |
| 4,823,280 | 4/1989 | Mailandt et al. | 364/514 |
| 5,032,825 | 7/1991 | Kuznicki | 340/636 |
| 5,065,084 | 11/1991 | Oogita | 340/636 |

FOREIGN PATENT DOCUMENTS

| | | | |
|---|---|---|---|
| 60-197049 | 10/1985 | Japan | 340/825.17 |

*Primary Examiner*—Michael Horabik

*Attorney, Agent, or Firm*—Willian Brinks Hofer Gilson & Lione

[57] ABSTRACT

A pager system includes a transmitter with a control unit for selectively transmitting radio signals having specific pager codes, and a plurality of portable pager receivers each having its own electrical energy source and adapted to respond to a specific pager code. The pager system further includes a central unit coupled to the control unit. The central unit includes a comparing unit and is coupled to a first memory for storing information relating to the individual pager receivers, a second memory for storing reference data, a clock, and a presentation unit. The comparing unit compares the contents of the first and second memories for a specific receiver and clock data, and signals the transmitter when a code signal is needed. The presentation unit generates a warning signal in response to a code signal received from the transmitter.

20 Claims, 1 Drawing Sheet

Figures 1, 2:
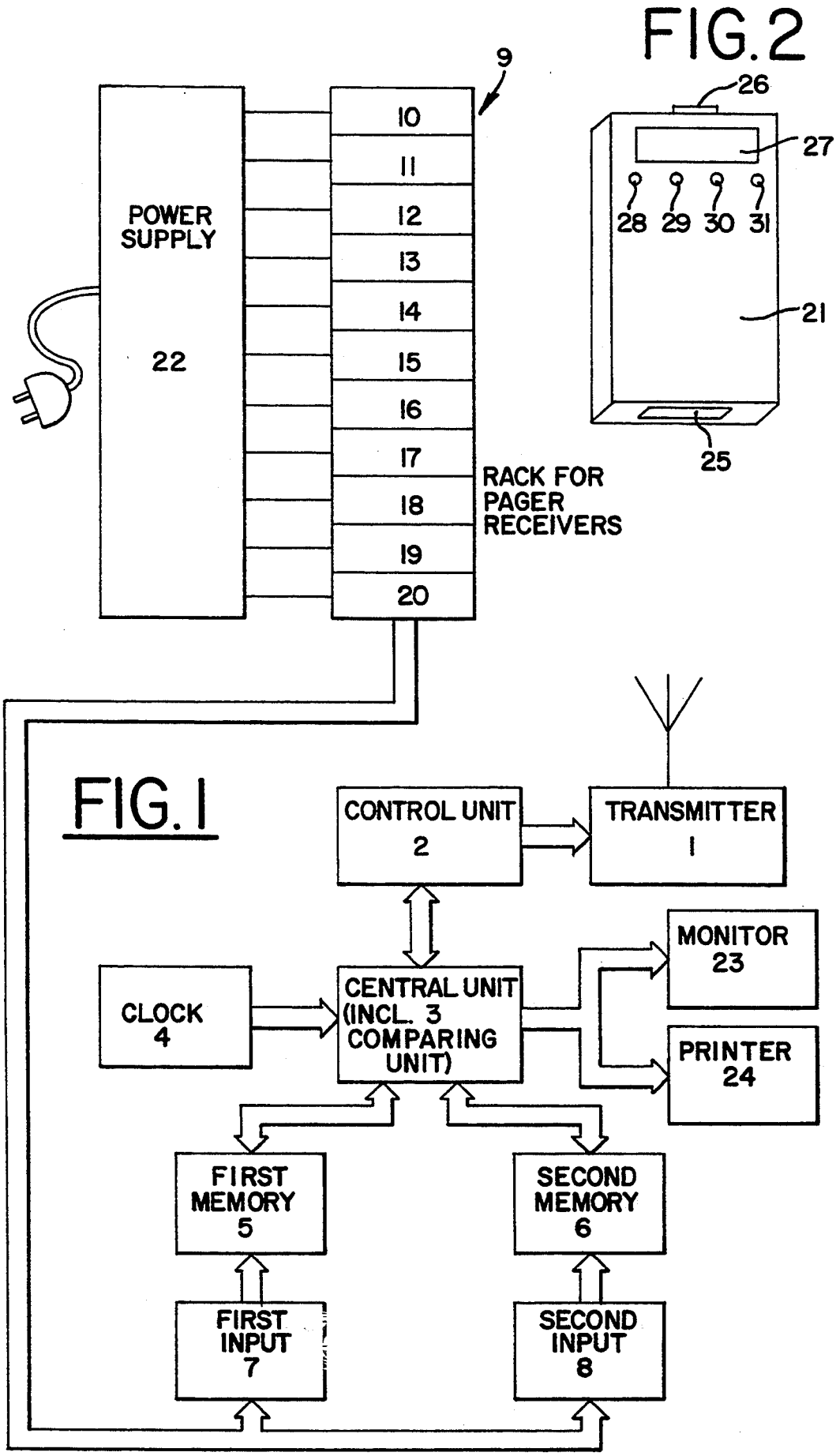

9
POWER SUPPLY
22
10
11
12
13
14
15
16
17
18
19
20
RACK FOR PAGER RECEIVERS
26
27
28
29
30
31
21
25

CONTROL UNIT 2
TRANSMITTER 1
CLOCK 4
CENTRAL UNIT (INCL. 3 COMPARING UNIT)
MONITOR 23
PRINTER 24
FIRST MEMORY 5
SECOND MEMORY 6
FIRST INPUT 7
SECOND INPUT 8

PAGER SYSTEM WITH USE MONITORING

The invention relates to a pager system comprising:

a transmitter with control means for selectively transmitting radio signals having a specific pager code chosen from a number of available pager codes; and a number of portable pager receivers each having its own electrical energy source and each adapted to respond to a specific code transmitted by the transmitter at appropriate activation of the control means.

Such a system is generally known. It is used for instance in companies to enable providing staff who may not always be present in their own work area with a signalling, particularly an acoustic signalling, in the case their presence is desired elsewhere, they have to report by telephone or undertake other action.

The object of the invention is to embody the known system such that it lends itself more easily to efficient use and to preventive detection of undesired situations, for instance over-prolonged use without replacing batteries or without timely charging of batteries and the like.

For this purpose the pager system according to the invention is characterized by a central unit coupled to the control means comprising:

a first memory in which information relating to the individual receivers can be stored;

a second memory for storing reference data;

a clock; and comparing means for comparing the content of the first memory, for a chosen receiver, the content of the second memory for this receiver and clock data, and controlling the control means subject to the result of this comparison such that the transmitter transmits radio signals having a specific warning code chosen from a number of available warning codes; and presentation means added to the individual receivers such as an LCD display, LEDs for generating a signal discernible by a user of the receiver in response to a received specific warning code.

The said codes can for instance be different bit patterns.

A system according to the invention, wherein use is made of non-rechargeable batteries, can have the special feature that the first memory is adapted to store the moment in time at which a new battery is placed in a receiver; and the second memory is adapted to store data relating to:

the energy content of the battery;

the stand-by consumption of the receiver;

the total stand-by time of the receiver;

the operating consumption of the receiver;

the total operating time of the receiver.

A system wherein use is made of rechargeable batteries as energy source, such as nickel-cadmium cells or the like and the system comprises a rack with associated power supply, in which rack each receiver can be placed in an individual plug-in position such that it makes contact with supply terminals for recharging its battery, can have the special feature that the first memory is adapted to store the total energy content of the battery on the basis of charging time, charge current and other stored relevant data; and the second memory is adapted to store data relating to:

the energy content of the battery;

the stand-by consumption of the receiver;

the total stand-by time of the receiver;

the operating consumption of the receiver;

the total operating time of the receiver.

The two above mentioned embodiments assume that the user, having received a warning, can undertake the necessary steps to bring an end to the identified, undesired or imminently undesired situation.

Use can however also be made of presentation means added to the central unit, for instance a monitor and/or a printer for displaying information relating to the warning codes. This latter embodiment offers the option of the system being continuously controlled by a system controller who can undertake the necessary action to carry out the necessary preventive or remedial steps.

The invention will now be elucidated with reference to the annexed drawing, in which:

FIG. 1 shows a block diagram of the stationary part of a system according to the invention; and FIG. 2 is a front view of a receiver forming part of the system according to the invention.

FIG. 1 shows a block diagram of the fixed part of a pager system according to the invention. This fixed part comprises a transmitter 1 coupled to a control unit 2. This latter controls the operation of the transmitter and, under the influence of a central unit 3, determines which codes are transmitted by the transmitter 1. These codes are specific to a particular receiver.

The central unit 3 also receives time information from a clock 4.

The central unit 3 is in information-exchanging contact not only with the control unit 2 but also with a first memory 5 and a second memory 6. These memories are in turn connected for supply of information to respectively a first input 7 and a second input 8. These inputs 7, 8 are in turn connected for information supply to a rack 9 with plug-in units 10-20. These plug-in units serve to store a receiver of the type shown in FIG. 2 when it is not in use. Each of these receivers, which is generally designated 21 in FIG. 2 for the sake of convenience, must be placed only at its own specific position in the rack 9 and can be provided for this purpose with mechanically complementary means or electronic recognition means. In the rack 9 a receiver 21 placed in a plug-in module 10-20 is charged from the mains-supplied power supply 22.

The central unit 3 is also coupled to a monitor unit 23 and a printer 24.

The pager receiver 21 according to FIG. 2 comprises a housing in which is incorporated an electronic receiving and signal processing unit, in addition to an internally chargeable battery and a recessed socket 25 which can co-act with electrical charging terminals present in the plug-in modules 10-20. The battery can be charged via these terminals.

Externally the housing carries an acoustic transducer 26 for generating acoustic paging signals, an LCD display 27 for displaying visual information and four LEDs 28, 29, 30, 31 for displaying diverse warning codes corresponding with different actions to be taken.

In the drawn embodiment, given only by way of example, the system according to the invention operates as follows. A number of warning codes is stored in the control unit 2. When the relevant code specific to a receiver is addressed by the central unit 3 the transmitter 1 transmits electromagnetic signals with the relevant code. The receiver 21 can respond thereto by energizing the transducer 26, the LCD display 27 and one of the LEDs 28–31. The carrier of the receiver is thus warned.

The central unit 3 is also in information-exchanging contact with the two memories 5 and 6. The first memory 5 receives via the first input 7 of the rack 9 information relating to the charge state of the battery of receiver 21. It is for instance assumed in this example that the receiver 21 is associated with the module 14. If the receiver 21 is inserted into the module 14 a current will flow through the appropriate supply line from the power supply 22 to the module 14. An appropriate detection signal is passed via the input 7 to the first memory 5 by measuring means (not drawn). Information can also be stored in the second memory 6 relating to the energy content of the battery. This memory 6 also receives time information via the central unit 3. The charge state of the battery can thus be established in combination with data relating to the current strength and the total battery capacity. The system is then, at the moment when the receiver is once again removed, aware of the time for which the receiver 21 can operate during different functions, for example on stand-by, during signalling situations such as generating sound signals and optical signalling. The content of memory 5 is continually updated with respect to receiver 21 (and of course also in respect of all other receivers).

Any aberrations which may be detected can be passed not only to a receiver but also to the monitor unit 23 and the printer 24, whereby a system controller is given the opportunity to take action.

Aberrations for detecting are for instance excessively prolonged use without interim charging. The system can also report non-use of a receiver.

The printer 24 is particularly practical for the system controller in obtaining a total overview of the system, for instance with respect to the number of calls to a particular receiver, the type of measures normally desired by the user, and the like. The system controller can also gain an insight into mislaying or loss of receivers through theft. For such cases the control unit 2 can if desired be provided with operating means (not drawn), whereby the system controller can directly control the control unit 2 to transmit a desired code to a particular receiver.

During normal use of the system it is capable as a result of the arrangement according to the invention of collecting data for preventive purposes which are necessary to prevent problems in the future.

Because data is assessed according to fixed standards the evaluation criteria and the levels of intervention are determined wholly objectively and unambiguously.

In a system with receivers supplied by non-rechargeable batteries the power supply 22 and the rack 9 are absent. The input 7 is in this case adapted for receiving data relating to the point in time at which a new battery is placed in the receiver. The data relating to the type of battery is read in into the second memory 6 via the second input 8. When for instance ten percent of the capacity of the battery is still left, a report is automatically sent to the receiver which, by means of adapted signalling, calls the attention of the user to the imminent end of the life of the battery.

I claim:

1. An electronic communication monitoring system comprising:

a plurality of portable receivers each having an energy source, each receiver including a communication system to communicate specific information to a user of the receiver, the communication system configured to communicate specific information upon receipt of a specific code by the receiver;

a control unit coupled to a transmitter to signal the receiver by transmitting through the transmitter the specific code for the receiver;

a first memory for storing information of each receiver;

a second memory for storing reference data of each receiver;

a clock having a time data output; and a central unit directly coupled to the control unit, to the first memory, to the second memory, and to the clock, the central unit including a comparison device for comparing the information of the receiver from the first memory to the reference data of each receiver from the second memory and the time data output to detect an undesired situation relating to the receiver and to communicate the undesired situation to the control unit wherein the control unit will cause the transmitter to transmit the specific code of the receiver corresponding to the undesired situation.

2. The electronic communication monitoring system of claim 1 further comprising a monitor connected to the central unit to display the undesired situation relating to a receiver.

3. The electronic communication monitoring system of claim 1 further comprising a printer connected to the central unit to display the undesired situation relating to a receiver.

4. The electronic communication monitoring system of claim 1 further comprising a presentation system connected to the central unit to display the undesired situation relating to receiver.

5. The electronic communication monitoring system of claim 1 wherein each energy source comprises a battery having an energy content; each receiver has a first level of power consumption and a second level of power consumption; the first memory stores the time data output at which the battery is connected to the receiver; and the second memory is adapted to store the energy content of the battery, the first level of power consumption of the receiver, the total time at which the receiver consumes power at the first level, the second level of power consumption of the receiver, and the total time at which the receiver consumes power at the second level.

6. The electronic communication monitoring system of claim 5 further comprising a storage rack having a specific plug corresponding to each receiver, wherein the storage rack stores each receiver when not in use, and the rack is coupled to the first memory and the second memory.

7. The electronic communication monitoring system of claim 1 wherein each energy source comprises a rechargeable battery having an energy content; each receiver has a first level of power consumption and a second level of power consumption; the first memory stores the energy content of the rechargeable battery; and the second memory is adapted to store the energy content of the battery, the first level of power consumption of the receiver, the total time at which the receiver consumes power at the first level, the second level of power consumption of the receiver, and the total time at which the receiver consumes power at the second level.

8. The electronic communication monitoring system of claim 7 wherein the energy content of each rechargeable battery is dependant on a charge current and a charge time of the rechargeable battery.

9. The electronic communication monitoring system of claim 7 further comprising a storage rack having a specific plug corresponding to each receiver, the storage rack storing each receiver when not in use.

10. The electronic communication monitoring system of claim 9 further comprising a storage rack having a power supply to allow each rechargeable battery to be recharged when the corresponding receiver is stored in the storage rack.

11. The electronic communication monitoring system of claim 1 wherein the communication system comprises a light emitting diode.

12. The electronic communication monitoring system of claim 5 wherein the communication system comprises an acoustic transducer.

13. The electronic communication monitoring system of claim 1 wherein the communication system comprises a liquid crystal display.

14. The electronic communication monitoring system of claim 1 wherein the specific code comprises a bit pattern.

15. An electronic communication monitoring system comprising:

a plurality of receivers, each receiver being connected to a battery and including a communication system to communicate information about the battery to a user of the receiver upon receipt of a specific code;

a control unit coupled to a transmitter to signal each receiver, the control unit signaling each receiver by transmitting through the transmitter a specific code for the receiver; and a central unit directly coupled to the control unit, to a clock, to a first memory and to a second memory, the first memory and second memory receiving information relating to each battery, the central unit including a comparison device for comparing the contents of the first memory to the contents of the second memory and the clock output to detect an undesired situation and communicating the undesired situation to the control unit, wherein the control unit will signal a specific code to a receiver corresponding to the undesired situation which will activate the communication system to communicate information about the battery corresponding to the specific code received.

16. The electronic communication monitoring system of claim 15 wherein the first memory is adapted to store each moment in time at which a battery is connected to a receiver.

17. The electronic communication monitoring system of claim 16 wherein the second memory is adapted to store the energy content of each battery, the stand-by consumption of each receiver, the total stand-by time of each receiver, the operating consumption of each receiver, and the total operating time of each receiver.

18. An electronic communication monitoring system comprising:

a plurality of receivers, each receiver being connected to a rechargeable battery and including a communication system to communicate information about the rechargeable battery to a user of the receiver, each communication system configured to communicate upon receipt of a specific code;

a control unit coupled to a transmitter to signal each receiver, the control unit signaling each receiver by transmitting through the transmitter a specific code for the receiver; and a central unit coupled to the control unit, to a clock, to a first memory and to a second memory, the first memory and second memory receiving information relating to each rechargeable battery, the central unit including a comparison device for comparing the contents of the first memory to the contents of the second memory and the clock output to detect an undesired situation and communicating the undesired situation to the control unit, wherein the control unit will signal a specific code to a receiver corresponding to the undesired situation which will activate the communication system to communicate information about the rechargeable battery corresponding to the specific code received.

19. The electronic communication monitoring system of claim 18 wherein the first memory is adapted to store the energy content of each rechargeable battery on the basis of charging time and charge current.

20. The electronic communication monitoring system of claim 19 wherein the second memory is adapted to store the energy content of each rechargeable battery, the stand-by consumption of each receiver, the total stand-by time of each receiver, the operating consumption of each receiver, and the total operating time of each receiver.

* * * * *

UNITED STATES PATENT AND TRADEMARK OFFICE

CERTIFICATE OF CORRECTION

PATENT NO. : 5,357,244
DATED : October 18, 1994
INVENTOR(S) : Nicolaas C. van Zijl It is certified that error appears in the above-indentified patent and that said Letters Patent is hereby corrected as shown below:

Col. 4, In claim 1, line 9, delete "the" and substitute --each--.

Col. 4, In claim 1, line 20, delete the second occurrence of "the" and substitute --each--.

Col. 4, In claim 1, line 21, delete "each" and substitute --the--.

Col. 4, In claim 4, line 4, after "to" insert --a--.

Col. 5, In claim 12, line 2, delete "5" and insert --1--.

Signed and Sealed this

Twenty-sixth Day of September, 1995

*Attest:*

Bruce Lehman

BRUCE LEHMAN

*Attesting Officer*

*Commissioner of Patents and Trademarks*